US011566374B2

(12) United States Patent
Lindblom

(10) Patent No.: US 11,566,374 B2
(45) Date of Patent: Jan. 31, 2023

(54) REFINING PLATE PROVIDED WITH REFINING BARS HAVING EDGE CREATING BAR CAVITIES

(71) Applicant: VALMET AB, Sundsvall (SE)

(72) Inventor: Thommy Lindblom, Hägersten (SE)

(73) Assignee: VALMET AB, Sundsvall (SE)

( * ) Notice: Subject to any disclaimer, the term of this patent is extended or adjusted under 35 U.S.C. 154(b) by 291 days.

(21) Appl. No.: 16/765,536

(22) PCT Filed: Nov. 20, 2018

(86) PCT No.: PCT/SE2018/051203
§ 371 (c)(1),
(2) Date: May 20, 2020

(87) PCT Pub. No.: WO2019/108113
PCT Pub. Date: Jun. 6, 2019

(65) Prior Publication Data

US 2020/0308767 A1 Oct. 1, 2020

(30) Foreign Application Priority Data

Dec. 1, 2017 (SE) ..... 1751482-9

(51) Int. Cl.
*D21D 1/30* (2006.01)
*B02C 7/12* (2006.01)

(52) U.S. Cl.
CPC ..... *D21D 1/306* (2013.01); *D21D 1/303* (2013.01); *B02C 7/12* (2013.01); *B02C 2210/02* (2013.01)

(58) Field of Classification Search
CPC ..... D21D 1/30; D21D 1/303; D21D 1/306; B02C 7/12
See application file for complete search history.

(56) References Cited

U.S. PATENT DOCUMENTS 550,300 A 11/1895 Sturtevant
3,523,649 A * 8/1970 Laakso ..... D21D 1/30 241/89.4

(Continued)

FOREIGN PATENT DOCUMENTS

SE 513807 C1 11/2000
WO WO 00/56459 A1 9/2000

(Continued)

OTHER PUBLICATIONS

Swedish Search Report, International-Type Search Report, Application No. 1751482-9, dated Jun. 12, 2018, 8 pages.

*Primary Examiner* — Faye Francis
(74) *Attorney, Agent, or Firm* — Foley & Lardner LLP

(57) ABSTRACT

A refiner plate that is adapted to be attached to a rotatable refiner disc on a refiner for mechanical treatment of lignocellulosic material. The refiner plate includes a refining surface that is adapted to be arranged oppositely a second refining surface of a second refiner disc on said refiner. The refining surface is provided with a plurality of refining bars, where at least one of the refining bars is provided with cavities that are at least partially embedded in the refining bars. At least one cavity provided on the at least one refining bar have one end arranged closer to the leading edge of a refining bar and one end arranged closer to the trailing edge of the refining bar and wherein the depth dimension of the cavity at the end is smaller than the depth dimension of the cavity at the end.

10 Claims, 12 Drawing Sheets

(56) References Cited

U.S. PATENT DOCUMENTS

| | | | | |
|---|---|---|---|---|
| 4,061,283 | A | 12/1977 | Kahmann | |
| 6,592,062 | B1 | 7/2003 | Virving | |
| 7,198,216 | B2 * | 4/2007 | Virving | B02C 7/12 241/261.2 |
| 7,419,112 | B2 * | 9/2008 | Sjostrom | B02C 7/12 241/261.3 |
| 2006/0202074 | A1 * | 9/2006 | Virving | D21D 1/306 241/261.2 |
| 2013/0306770 | A1 * | 11/2013 | Sjostrom | D21D 1/303 241/245 |

FOREIGN PATENT DOCUMENTS

| | | | |
|---|---|---|---|
| WO | WO 2004/103567 | A1 | 12/2004 |
| WO | WO 2005/032721 | A | 4/2005 |
| WO | WO 2007/065971 | A1 | 6/2007 |

* cited by examiner

Fig. 7a
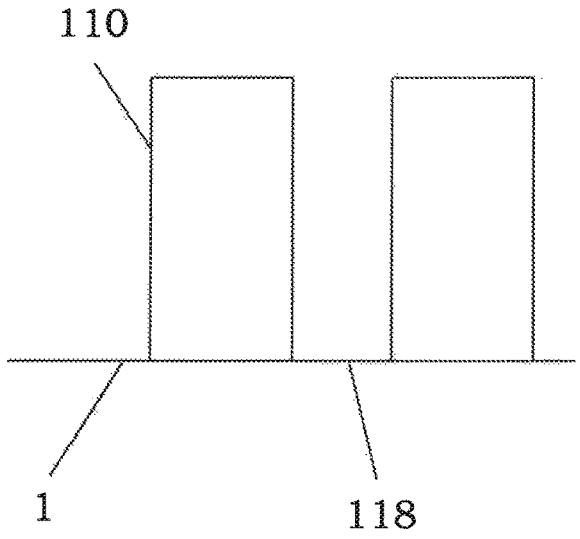
Fig. 7b
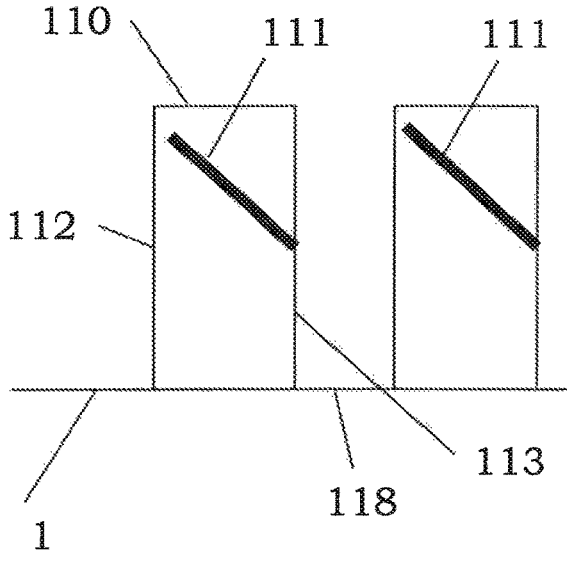
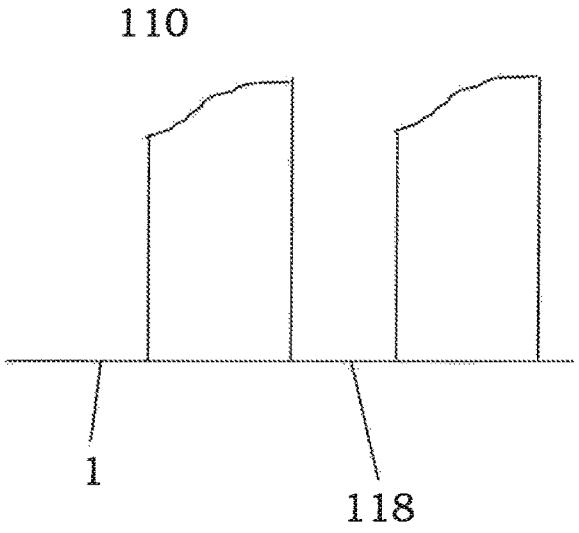
Fig. 7c
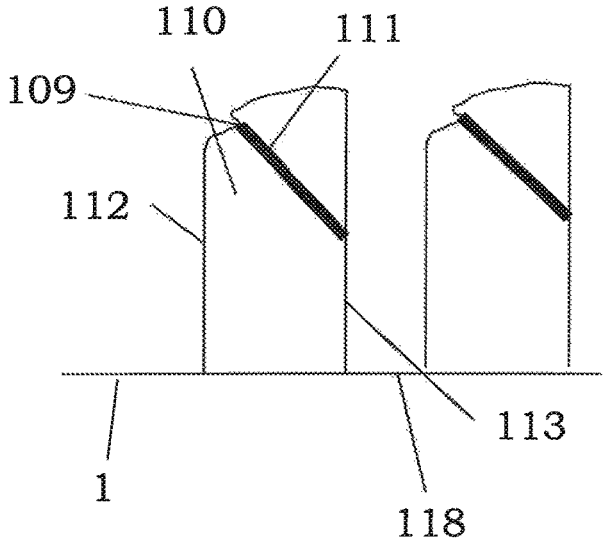
Fig. 7d

REFINING PLATE PROVIDED WITH REFINING BARS HAVING EDGE CREATING BAR CAVITIES

TECHNICAL FIELD

The proposed technology generally relates to a refiner plate for a disc refiner. More particularly it relates to a refining plate that comprises refining bars for mechanical treatment of lignocellulosic material in a refiner where at least some of the refining bars on the refining plate are provided with edge creating cavities.

BACKGROUND

Common mechanical pulp refiners usually comprises two relatively rotating discs, e.g. one stationary disc and one rotating disc, on which a refiner plate, also referred to as a refining element or a refining segment, are attached. During use of the refiner, lignocellulosic material such as wood fibers are mechanically treated, e.g. grinded or worked, between the refining plates of the two relatively rotating discs. To obtain an effective treatment of the material it is quite common to provide the refining surface of the refining plates with refining bars extending radially along the plate whereby both the refining bars themselves and the grooves that will be defined between the refining bars provides an improved grinding action. The leading edges of the bars, i.e., the edges of the refining bars that during rotation of the refining plates are first brought into contact with the material, will also act to provide a separation and fibrillation of the fibers whilst the grooves will enable both a transportation of the fibers as well as a removal of any steam produced during the grinding action. Common refining plates may also be provided with structures known within the art as dams. The dams are also extended structures that are provided in the grooves of the refining plate and their main purpose is to halt or interrupt the material flow in the grooves in order to keep the material in the grinding or refining area for a longer time duration.

The structures provided on the refining plates, i.e. the bars, the grooves and the dams, are during use however affected by substantial forces due to, inter alia, the high rotation speed of the rotating disc(s). The rotation speed in combination with any debris present in the organic material will impart substantial wear on the refining bars.

As a consequence of the wear the leading edges of refining bars may get smoothened out whereby the efficiency of a refining plate will be negatively affected. A refining bar with a smoothened out leading edge will lose a lot of the positive effects mentioned above.

In SE 513807 there is proposed a particular solution to this problem. The proposed solution is based on the provision of refining bars whose uppermost surface is provided with a ledge whereby at least two edges arranged at different height are created on the refining bar.

Even though this solution is quite satisfactory for extending the service length of a refiner plate, the added structures may negatively affect the material flow on the refining plate.

There is therefore a need within the art to further improve refining plates and in particular to provide at least a partial solution to the problem of deteriorating refining bars for a refining plate while at the same time reducing any impact on the material flow.

SUMMARY

It is an object of the proposed technology to provide a refining plate having an extended service length.

It is another object of the proposed technology to provide a refining plate provided with refining bars where even worn down refining bars provide a good refining action.

There is another object of the proposed technology to provide a refining plate having an extended service length that reduces the impact on the material flow on the refining plate.

It is yet another objective of the proposed technology to provide a refiner equipped with refining plates having an extended service length.

These and other objects are met by embodiments of the proposed technology.

According to a first aspect, there is provided a refiner plate adapted to be attached to a rotatable refiner disc on a refiner for mechanical treatment of lignocellulosic material. The refiner plate comprises a refining surface adapted to be arranged oppositely a second refining surface of a second refiner disc on the refiner. The refining surface being provided with a plurality of refining bars, where at least one of the refining bars are provided with cavities that are at last partially embedded in the refining bar and that at least one cavity provided on the at least one refining bar have one end arranged closer to the leading edge of a refining bar and one end arranged closer to the trailing edge of the refining bar and wherein the depth dimension of the cavity at the end arranged closer to the leading edge is smaller than the depth dimension of the cavity arranged closer to the trailing edge.

According to a second aspect there is provided a refiner for mechanical treatment of organic/cellulosic material. The refiner comprising two oppositely arranged refiner discs, wherein at least one of the refiner discs comprises a rotatable refiner disc and at least one of the refiner discs comprises a refiner plate according to the first aspect.

Embodiments of the proposed technology makes it possible to extend the service length of a refining plate while at the same time reducing the impact on the material flow on the refining plate.

Other advantages will be appreciated when reading the detailed description.

BRIEF DESCRIPTION OF THE DRAWINGS

The embodiments, together with further objects and advantages thereof, may best be understood by making reference to the following description taken together with the accompanying drawings, in which:

FIGS. 7*a* and 7*b* are schematic diagrams of a known refiner plate provided with refining bars before wearing and after wearing.

FIGS. 7*c* and 7*d* are schematic diagrams of a refiner plate provided with refining bars according to an embodiment of the proposed technology. The refining bars are illustrated before any wear and after having been partially worn down.

DETAILED DESCRIPTION

Throughout the drawings, the same reference designations are used for similar or corresponding elements.

Generally, all terms used herein are to be interpreted according to their ordinary meaning in the relevant technical field, unless a different meaning is clearly given and/or is implied from the context in which it is used. All references to a/an/the element, apparatus, component, etc. are to be interpreted openly as referring to at least one instance of the element, apparatus, component, etc., unless explicitly stated otherwise. Any feature of any of the embodiments disclosed herein may be applied to any other embodiment, wherever appropriate. Likewise, any advantage of any of the embodiments may apply to any other embodiments, and vice versa. Other objectives, features and advantages of the enclosed embodiments will be apparent from the following description.

Figure 1:
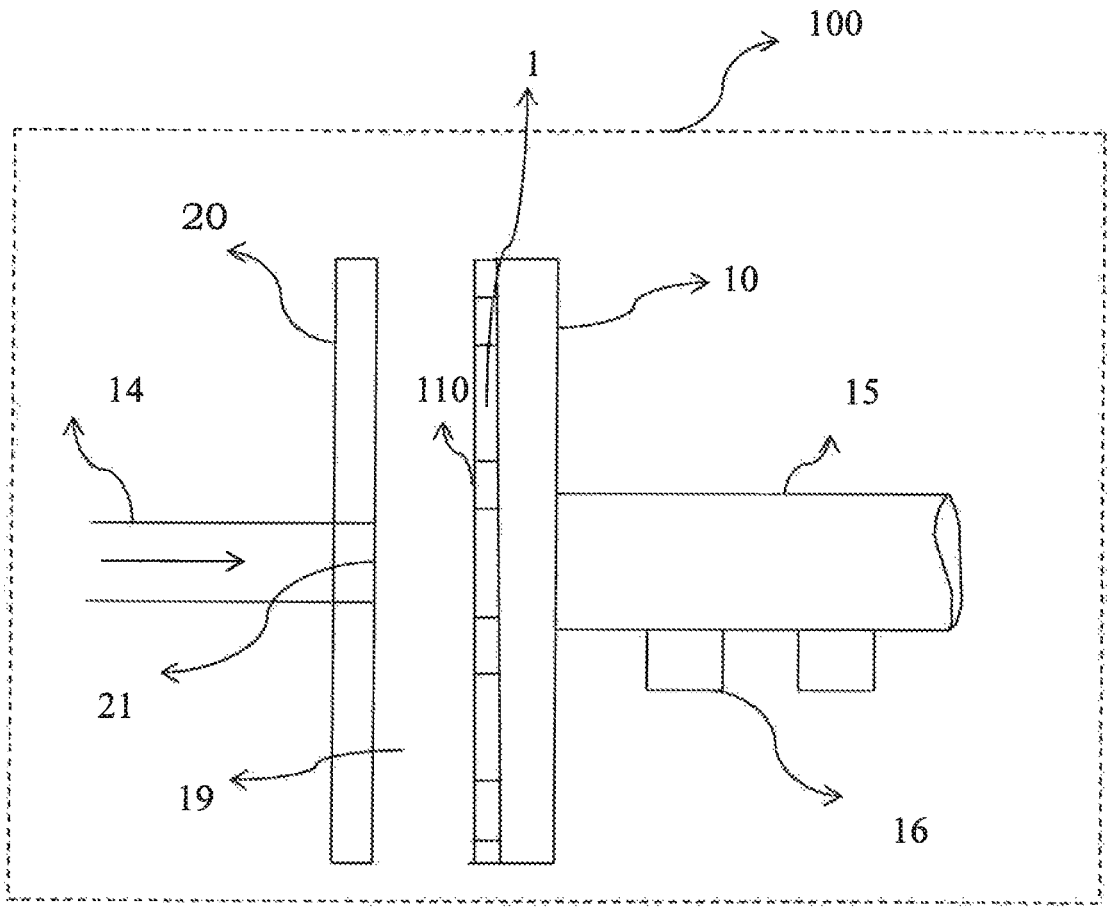
FIG. 1 is a schematic diagram illustrating a common refiner where a refining plate according to the proposed technology can be utilized.

For a better understanding of the proposed technology, it may be useful to begin with a brief overview of a common refiner equipped with refining discs having refining plates. To this end reference is made to FIG. 1. FIG. 1 is a schematic diagram illustrating a cross-sectional view of an exemplary refiner 100 that is adapted to mechanically treat lignocellulosic material, e.g., pulp. The parts of the refiner that is most relevant for the present invention concerns the refining discs 10, 20 and their corresponding refining plates 1, 2. A refining plate, or equivalently a refining segment comprises a structure that is adapted to be fitted on a disc refiner so that a refining surface of the refining plate is facing the material to be grinded or mechanically treated. A refining plate may thus in a particular embodiment be a structure that is attachable to a disc refiner.

The refiner 100, or equivalently, the disc refiner, in FIG. 1 is schematically illustrated as merely housing the components that are of importance for understanding the environment of the present invention. Examples of refiner components that are not shown in the figure are an electrical motor for driving e.g. the rotation axis, the feeding mechanism for the pulp etc. Inside the refiner 100 a rotatable refining disc 10 and a stationary refining disc 20 is linearly aligned along an axis. A rotatable refining disc 10 is often referred to as a rotor while a stationary refining disc 20 is often referred to as a stator. These terms may thus be used interchangeably. The rotatable refining disc 10 is attached to a rotation axis 15 that may be arranged on bearings 16. The rotation axis 15 is in turn connected to a motor, not shown, that is adapted to rotate the axis 15 during use of the refiner. The rotation of the axis 15 will impart a rotation to the rotatable refining disc 10. The stationary refining disc 20 facing the rotatable refining disc 10 is in this particular example of a refiner provided with a centrally located through-hole 21. The through-hole 21 extends between the pulp feeding channel 14 and a refining zone 19. During use of the refiner, lignocellulosic materiel, e.g., pulp, will be fed by means of a feeding mechanism, not illustrated in the drawing, through the feeding channel 14. The pulp will pass the through-hole 21 in the stationary refiner disc 20 and enter the refining zone 19. The refining zone 19 is thus defined by the gap between the rotatable refining disc 10 and the stationary refining disc 20. This gap can be quite small during operation. The rotatable refining disc 10 may in particular examples of refiners 100 be provided with a center plate having a surface facing the incoming pulp. The center plate is in such an embodiment adapted to direct any incoming pulp, i.e., incoming from the pulp feeding channel 19, toward the outer areas of the refining zone. In the outer areas of the refining zone, the refining discs in the shape of the rotatable refining disc 10 and/or the stationary refining disc 20 are provided with a refining plate 1 or a refining segment 1 facing the refining zone 19. The refining plate 1 is provided with refining bars 110 that are adapted to facilitate the grinding of the pulp. These refining segments or refining bars 110 defines protrusions on the surfaces of the refining discs 10, 20. Interspersed between the refining bars 110 are grooves that enables transport of the grinded pulp. In FIG. 1 it is illustrated that only the rotatable refining disc 10 is provided with a refining plate 1 having refining bars 110. There are also embodiments of a refiner where a stationary refining disc is provided with a corresponding refining plate 1. There are also examples of refiners 100 where both the refining discs 10, 20 are rotatable. All of these different embodiments are compatible with the proposed technology.

As has been mentioned earlier, a particular problem associated with refining segments or refining plates provided with refining bars is that an extended use will tend to wear down the refining bars, making them exceedingly smoother. As was previously noted, a specific purpose of the refining bars is that they should provide a separation and fibrillation of the lignocellulosic fibers. This is facilitated by any sharply defined leading edges on the refining bars. An extended use of the refining plate tends however to smoothen out these leading edges and thereby rendering the refining plate less effective. The proposed technology aims to at least provide a counter measure to the negative impact caused by wear due to extended use. The main mechanism for achieving this purpose is to furnish the refining bars with hidden bar edges. These hidden bar edges will get gradually exposed when the refining bars are worn down. The hidden bar edges may be provided by means of cavities that are at least partially embedded in the refining bars. With partially embedded is here, and in what follows, intended that:

a) The cavities are completely housed within a refining bar before the refining bar has been used. The boundaries between the refining bar bulk material and the cavities will define hidden edges that will get exposed when the refining bar has been worn down. Particular examples of these types of cavities will follow; or b) The cavities are recesses or grooves that are provided on the upper surface of a refining bar. The cavities will thus be partly housed within a refining bar and the difference with the embodiment in a) above is that they opens up on the upper surface in such a way that they define recesses or grooves instead of completely housed cavities. The edges of the recesses and grooves will define hidden bar edges that will gradually be exposed due to the wearing of the refining bars. Particular examples of such recesses and grooves will be given.

With cavities are in what follows intended either the completely embedded cavities or the recesses or grooves that were described above.

The cavities may have an extended shape and form a type of channels that are embedded into the material of the refining bars. Preferably the cavities should have a direction of extension that enables the formation of an edge in the direction of the leading edge of a refining bar. The leading edge of a refining bar are here defined as the edge surface of the refining bar that first encounters the lignocellulosic/organic material during rotation. See for example FIG. 3 where the left edge surface of the refining bar 110 constitutes the leading edge with the particular rotation direction illustrated by R. The main point with this particular design is that any hidden edges that are defined by the added cavities will emerge as new and sharp leading edges when the original surfaces of the refining bars has been worn down and smoothened out. These emergent, or secondary, leading edges will in turn supersede the edges of the original refining bars and will thus act to facilitate the separation and fibrillation of the lignocellulosic fibers. A particular refining plate design having refining bars provided with hidden bar edges, defined by e.g., the boundary between the refining bar bulk material and the cavities or channels provided therein, can therefore ensure that the refining plate can be used effectively for a longer time since the gradual exposure of the hidden edges due to the wear of the refining bar will create secondary sharp edges. The proposed technology therefore provides a refiner plate 1 that is adapted to be attached to a rotatable refiner disc 10 on a refiner 100 for mechanical treatment of lignocellulosic material. The refiner plate 1 comprises a refining surface 11 that is adapted to be arranged oppositely a second refining surface 21 of a second refiner disc 20 on the refiner 100. The refining surface 11 is provided with a plurality of refining bars 110, where at least one of the refining bars 110 is provided with cavities 111 that are at least partially embedded in the refining bar 110. Moreover, at least one cavity 111 provided on the at least one refining bar 110 have one end 111*a* arranged closer to the leading edge 112 of a refining bar 110 and one end 111*b* arranged closer to the trailing edge 113 of the refining bar and wherein the depth dimension of the cavity at the end 111*a* is smaller than the depth dimension of the cavity at the end 111*b*. These cavities 111 may, as was stated earlier, have the shape of extended cavities thus forming either completely embedded channels or grooves or forming recesses or grooves on the upper surface of the refining bar.

There is in other words provided a refiner plate or, equivalently, a refiner segment 1 having a refining surface 11 that is provided with a set of refining bars 110. The refining bars 110 may be provided on the refining plate in a multitude of patterns and in a number of different shapes. They may for example be provided in a radially symmetric pattern, e.g., a set of refining bars whose intermediate distance diverges on the way towards the periphery of the refining plate. They may also be provided on the surface in the shape of more or less rectangular blocks, but they may also be provided as curved structures. The refining bars may also be tilted relative an orthogonal direction of the refining surface, i.e., tilted relative the normal direction of the refining surface. Regardless of the shape and pattern, the individual refining bars should preferably display a cross-sectional shape that provides an edge, or several edges, that is more or less sharply defined.

Figure 2:
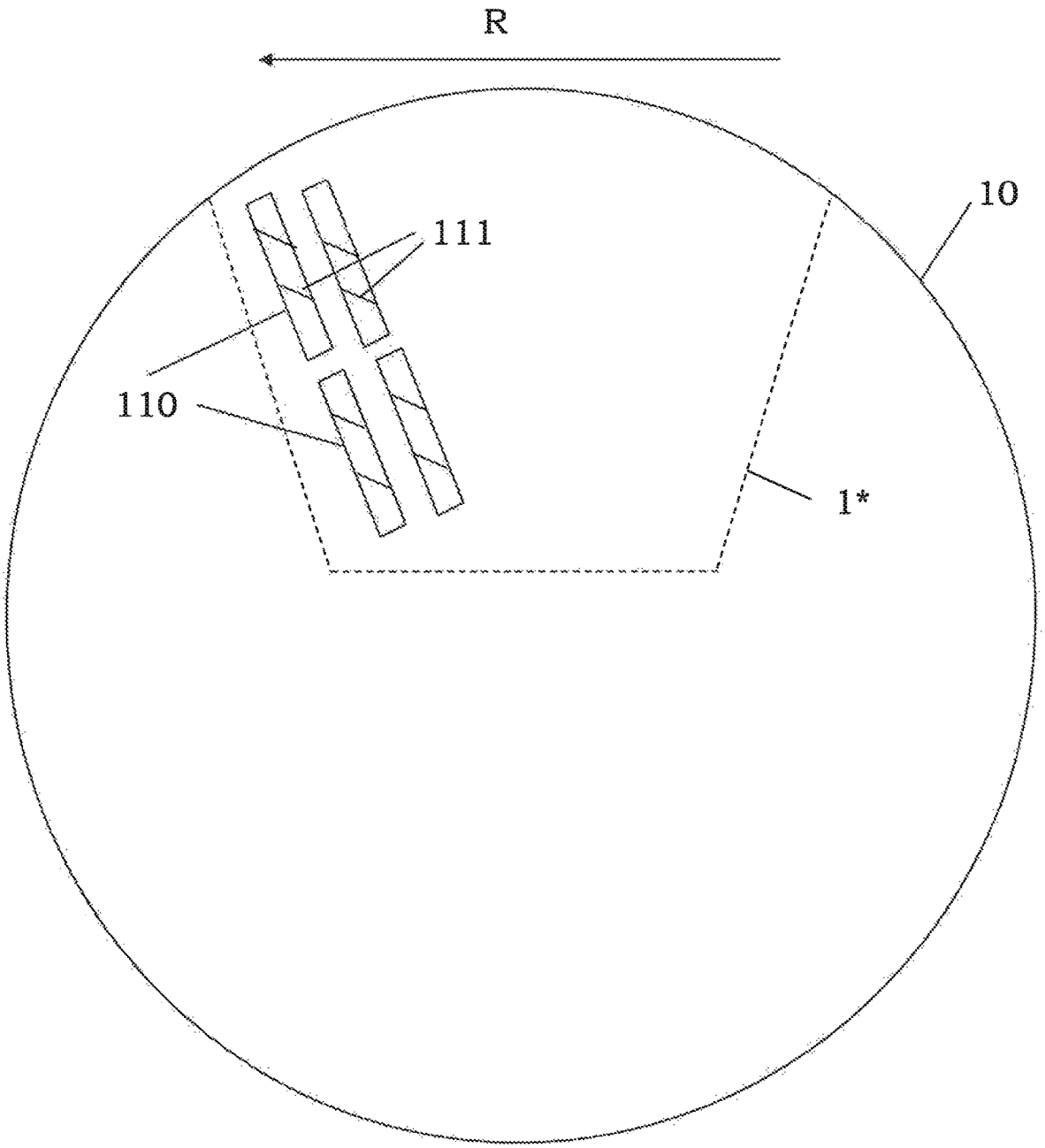
FIG. 2 is a schematic diagram of an embodiment of the proposed technology illustrating a section of a circular refining plate, which section comprises a few refining bars provided with cavities according to the proposed technology.

FIG. 2 provides a schematic illustration of a refining segment 1* arranged on a refining disc 10. The refining segment 1*, which forms part of a refining plate 1, is provided with a set of individual refining bars 110. Only four refining bars 110 are shown to avoid cluttering the drawing. Each of the refining bars 110 are in this particular illustration provided with two distinct and separate cavities 111 that are schematically illustrated by dark lines. According to a particular embodiment of the proposed technology there is provided a refiner plate 1, wherein the cavities 111 have an elongated shape. The cavities 111 may for example be given the shape of extended channels that are running in the bulk of the refining bars 110 or provided so that they extend in a direction that runs from a surface of the refining bars 110 into the bulk of the same.

Some of the embodiments contemplated herein will now be described more fully with reference to the accompanying drawings. Other embodiments, however, are contained within the scope of the subject matter disclosed herein, the disclosed subject matter should not be construed as limited to only the embodiments set forth herein; rather, these embodiments are provided by way of example to convey the scope of the subject matter to those skilled in the art.

According to a particular embodiment of the proposed technology there is provided a refiner plate 1 wherein at least one of the cavities 111 is completely embedded in the refining bar 111, The cavity may for example have an elongated shape and will thereby be forming a channel that is embedded in the refining bar 110.

According to an alternative embodiment of the proposed technology there is provided a refiner plate 1 wherein at least one of the refining bars of the plurality of refining bars 110 comprises cavities 111 that extend from the surface of a refining bar 110 into the bulk of the same refining bar 111.

A particular reason for providing cavities that extend into the bulk of the refining bar instead of providing structures on the surface of the refining bar is to reduce the impact on the material flow on the refining plate. Structures provided on the surface of the refining bar may interact with the material flow and create vortices and turbulence in the material. This may not be ideal since a more smooth flow will ensure that the material get evenly grinded.

Figure 12:
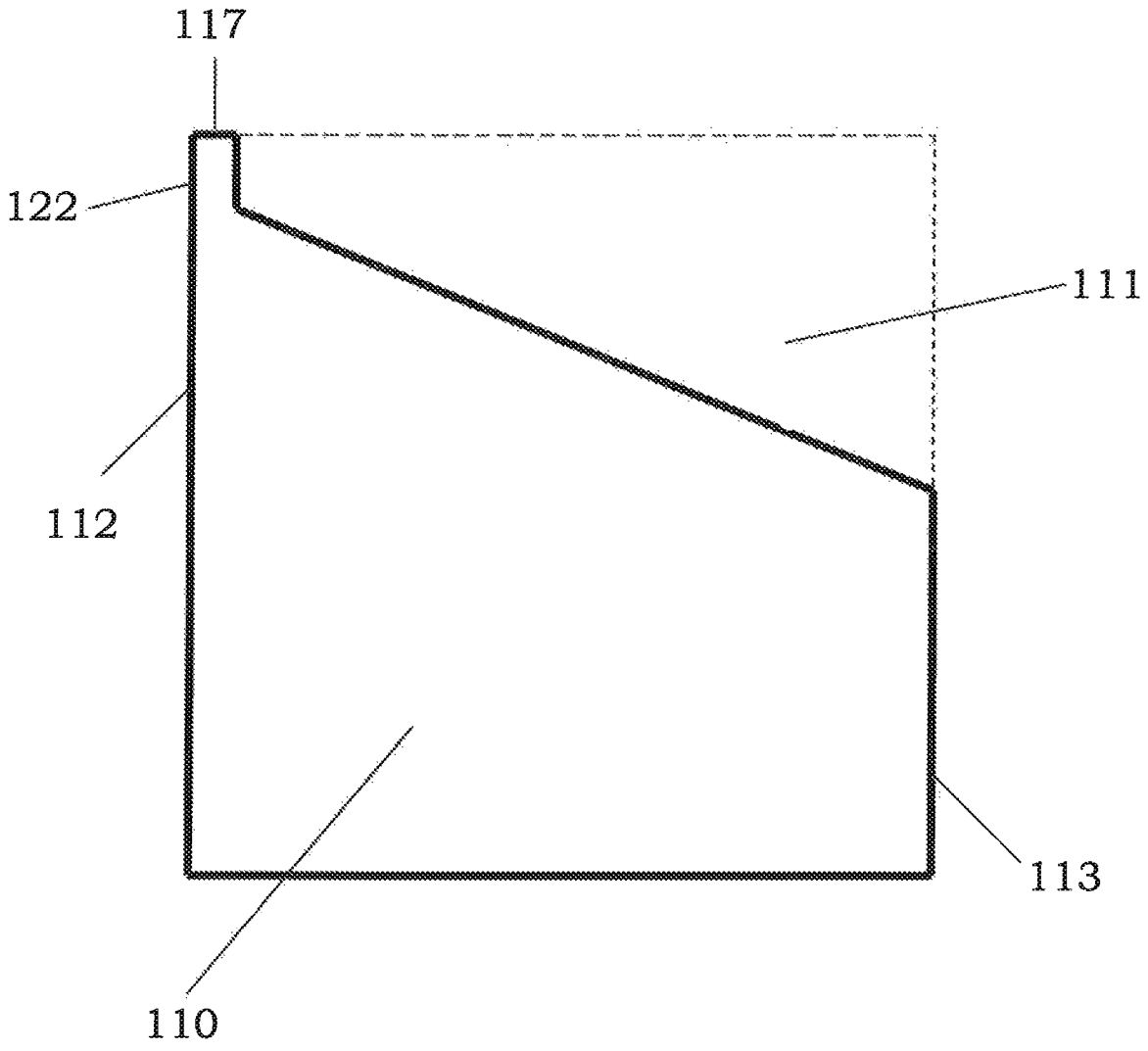
FIG. 12 is a schematic diagram of an embodiment of the proposed technology illustrating a cross-section view of a refining bar comprising a cavity in the shape of a recess with gradually increasing depth.

According to another particular embodiment of the proposed technology there is provided a refiner plate 1 wherein at least one of the cavities 111 comprises a recess on the upper surface 117 of the refining bar 110, thereby forming a cavity that is partially embedded in said refining bar 110. A cross-sectional view of refining bar provided with such a recess is schematically illustrated in FIG. 12. In this drawing a refining bar 110 is illustrated in a cross-section taken along a line from a leading edge 112 of the refining bar to a trailing edge 113 of the refining bar. Since this is a cross-section view it is clear that the cavity 111 is surrounded by refining bar bulk material in all directions except for the opening on the surface 117 and a possible opening on the trailing edge 113. The top surface, or upper surface, 117 of the refining bar illustrated in FIG. 12 has in this particular embodiment been provided with cavities 111 in the shape of recesses or grooves. These recesses or grooves extend from the top surface 117 into the bulk of the refining bar. During use the section 122 of the refining bar will get worn down and new leading edges defined by the recess 111 will emerge. The particular shape given to the recess, i.e., the gradually increasing depth toward the trailing edge 113 will be described in what follows.

Below there will be given a number of different embodiments of the proposed technology. The specifics of these embodiments are equally valid for a refining bar that comprises completely embedded cavities and a refining bar that comprises partially embedded cavities, i.e., cavities that forms recesses or grooves on the upper or top surface of the refining bar.

Figure 3:
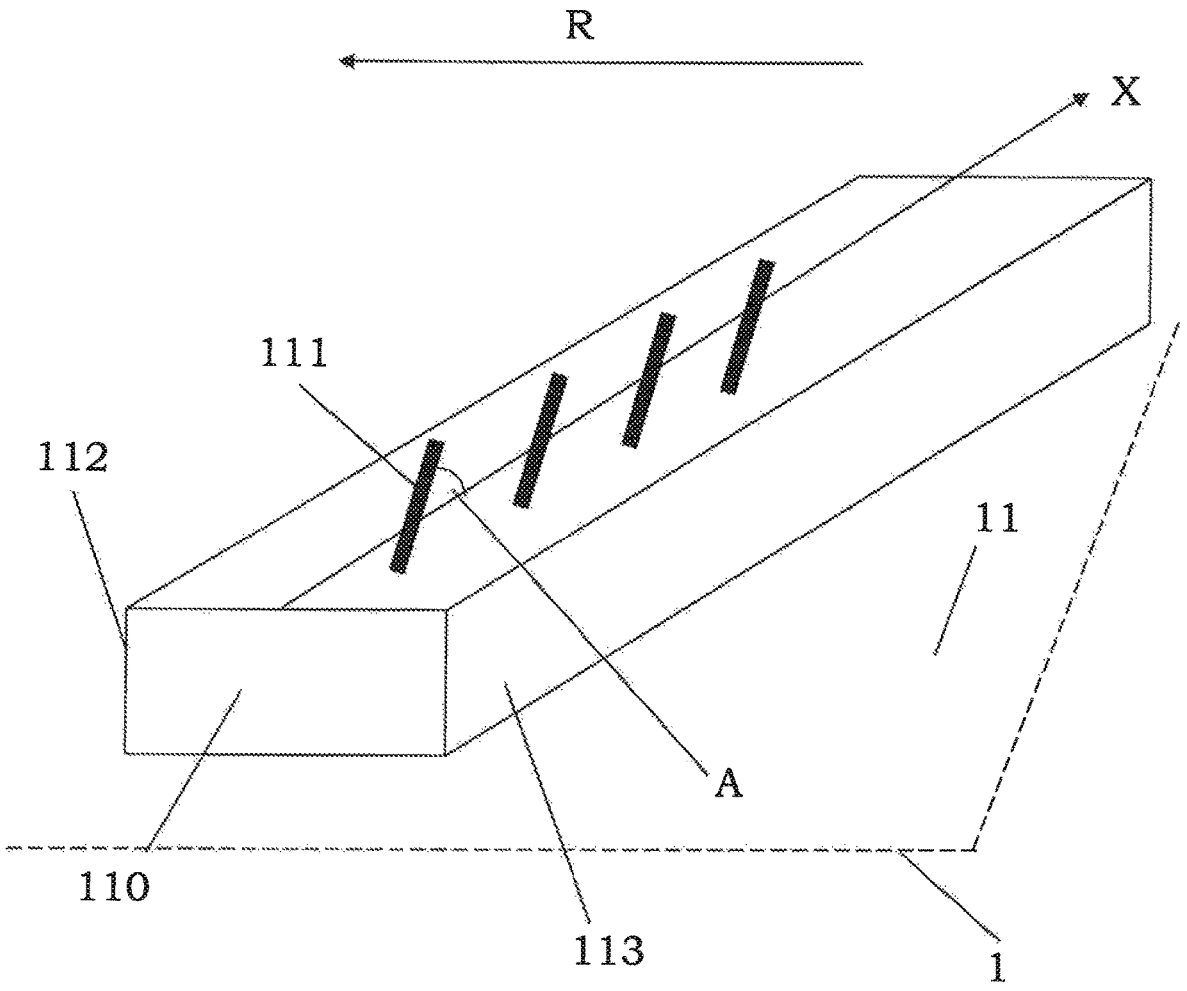
FIG. 3 is a schematic diagram of an embodiment of the proposed technology illustrating a single refining bar provided with cavities in the shape of channels that are arranged in the refining bar so that an angle A is formed between the direction of the channel and the length direction of the refining bar.

A particular embodiment of the proposed technology provides a refiner plate 1 wherein the cavities 111 are provided in at least one refining bar 110 in such a way that an angle A, $0°<A<45°$, preferably $5°<A<45°$, is formed between the length direction of the cavities 111 and the length direction of the bar 110. FIG. 3 provides a schematic diagram illustrating this particular embodiment for the simple case of a single bar 110. The single bar is provided on the refining surface 11 of the refining plate 1. Only a section of the refining plate is illustrated by means of dashed lines. The cavities 111 are in FIG. 3 provided on a refining bar 110 in such a way that they are angled relative the length direction Z of the refining bar 110. An angle A is thus defined between the direction of the cavities and the length direction of the refining bar. It is not necessary that all cavities are angled relative the length direction Z. It is instead possible to provide cavities in such a way that there is formed a different angle between each singe cavity and the length direction. The five cavities on the refining bar illustrated in FIG. 3 may for example be provided so that five different angles $A_1$, $A_2$, . . . , $A_5$ are formed. Any combination of angles is also possible, e.g. having tree cavities with the same angle and two with differing angles. The angles for particular cavities may e.g. be selected in order to further reduce any influence of the material flow on the refining plate. The angles may thus be selected in such a way that a gradual exposure of emerging edges are obtained. That is, the emerging edges will get more and more pronounced the more worn down the refining bars become. A specific embodiment suitable to achieve this purpose will be describe later with reference to FIG. 11.

Figure 4:
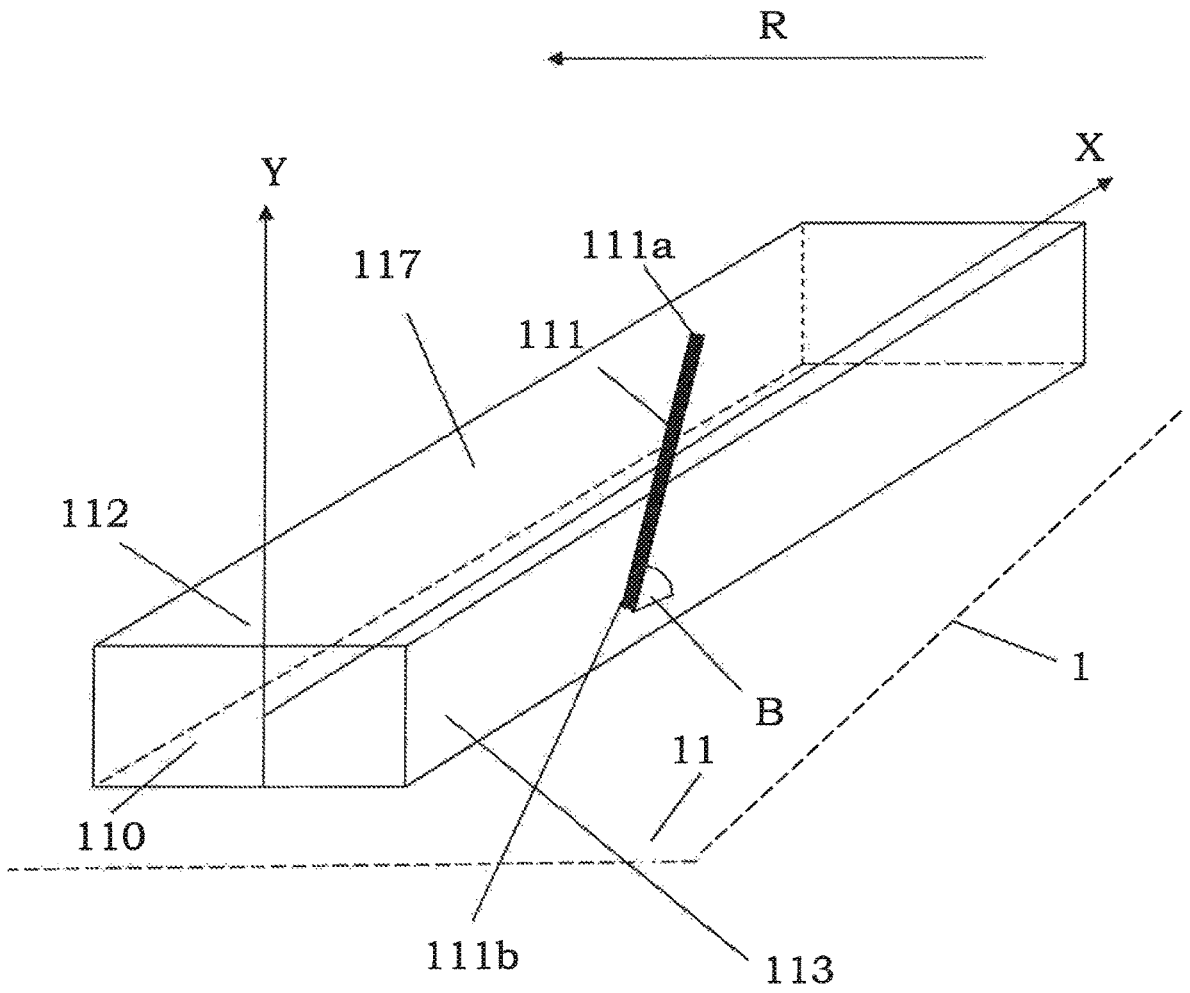
FIG. 4 is a schematic diagram of an embodiment of the proposed technology illustrating a single refining bar provided with a single cavity in the shape of a channel that extends into the bulk of the refining bar in such way that an angle B is formed between the direction of the channel and the normal direction of the surface.
Figure 5:
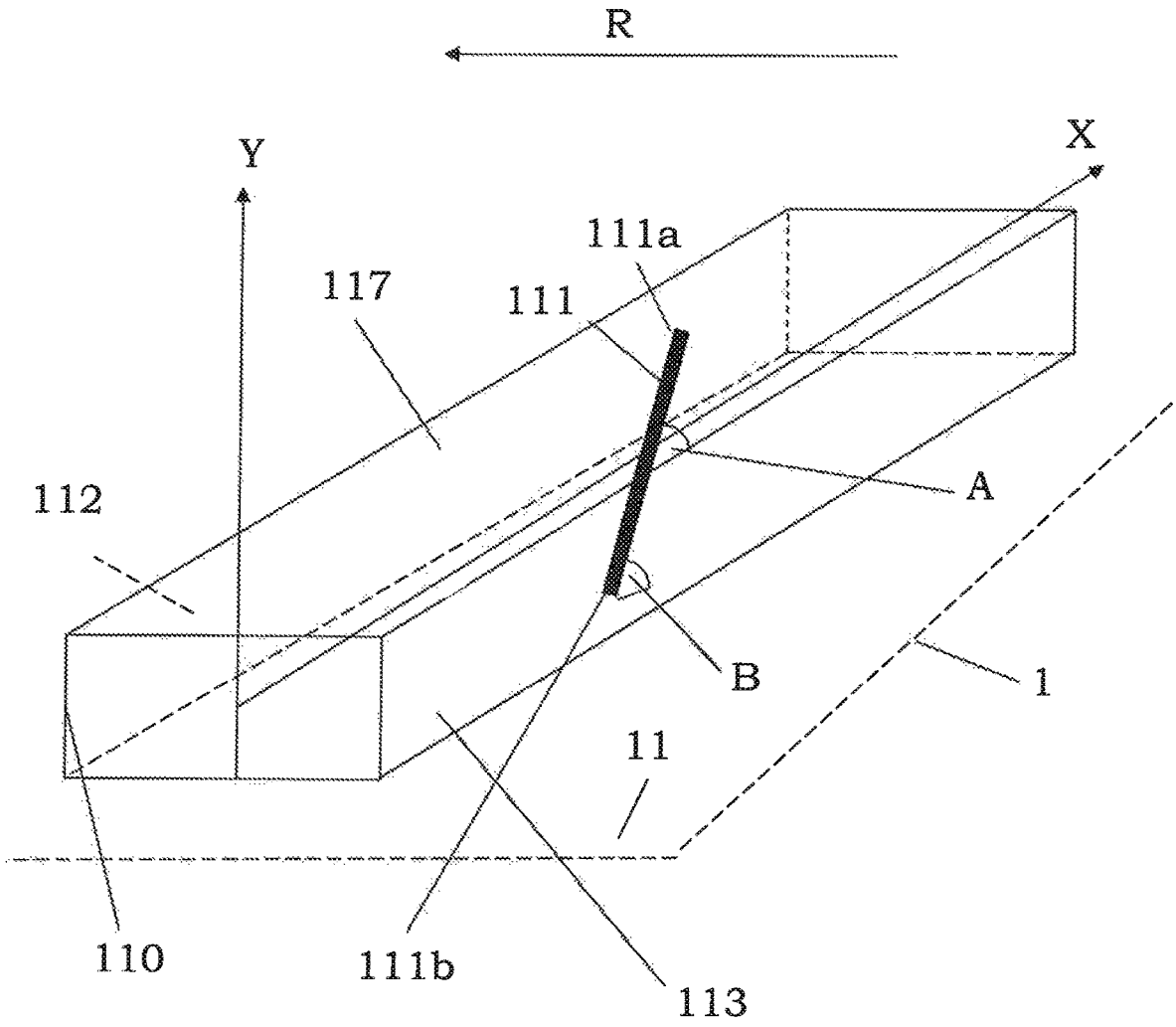
FIG. 5 is a schematic diagram of an embodiment of the proposed technology illustrating a single refining bar provided with a single cavity in the shape of a channel that extends into the bulk of the refining bar in such way that an angle A is formed between the direction of the channel and the length direction of the refining bar and an angle B is formed between the direction of the channel and the normal direction of the surface.

Another embodiment of the proposed technology provides a refiner plate 1, wherein at least one refining bar 110 comprises cavities 111 that extends into the bulk of the refining bar 110, and wherein the length direction of the cavities 111 form an inclination angle B, $0°<B<45°$, preferably $5°<B<45°$ with the direction of the normal of the refining surface 11. With the direction of the normal is here intended a direction that is orthogonal to the surface of the refining plate 1. FIG. 4 provides a schematic diagram illustrating this particular embodiment of the proposed refining plate. FIG. 4 illustrates more explicitly a refiner plate 1 which for simplicity is provided with a single refining bar 110. The single refining bar 110 is provided on the refining surface 11 of the refining plate 1. Only a section of the refining plate is illustrated by means of dashed lines. In this embodiment at least one of the refining bars 110 comprises cavities 111 having an extended shape, i.e. having the form of a channel or a groove, that extends into the bulk of the refining bar 110 in such a way that the length direction of the cavities 111 form an inclination angle B, $0°<B<45°$ with the direction of the normal to refining surface 11, i.e., in the direction of the Y-axis in FIG. 4. Even though it is not illustrated in the drawing the cavities 111 may extend all the way to the upper surface of the refining bar thereby defining recesses on the surface of the refining bar where these recesses get an increasingly large depth towards the trailing edge 113. In this embodiment the inclination angle B provides a particular measure of the slope of the recess 111. That is, by having an inclination angle B it is ascertained that the recess gets deeper towards one end, FIG. 5 give a schematic illustration of yet another embodiment of the proposed technology that provides a refiner plate 1 having at least one refining bar provided with cavities 111. The cavities 111 have an elongated shape and are provided on the refining bar 110 in such a way that they have one end 111*a* that is arranged closer to the leading edge 112 of the refining bar 110 and one end 111*b* that is arranged closer to the trailing edge 113 of the refining bar 110.

FIG. 5 also provides a schematic diagram illustrating another embodiment of the proposed technology wherein at least one refining bar 110 is provided with cavities that are angled with an angle A relative a length direction, i.e., the Z-direction, of the refining bar 110 and also tilted relative a direction normal to the refining surface 11, i.e., in the Y-direction, with an angle B. The angles A and B may take values in the interval $0°<A<45°$ and $0°<B<45°$. For example, $5°<A<45°$ and $5°<B<45°$, or any combination of angles A and B within the specified interval. This particular embodiment provides cavities 111 whose direction in the bulk of a refining bar are determined by two angles, A and B, where A describes the angling relative the length direction of the refining bar and B describes the tilting relative the normal direction of the refining surface. Even though it is not illustrated in the drawing the cavities may extend all the way to the upper surface 117 of the refining bar thereby defining recesses on the surface of the refining bar where these recesses get an increasingly large depth towards the trailing edge 113. In this embodiment the angles A and B defines recesses 111 that are both angled relative the length direction of the refining bar 110 and have increasingly larger depth towards a particular end, preferably the trailing end of the refining bar.

Figure 6A:
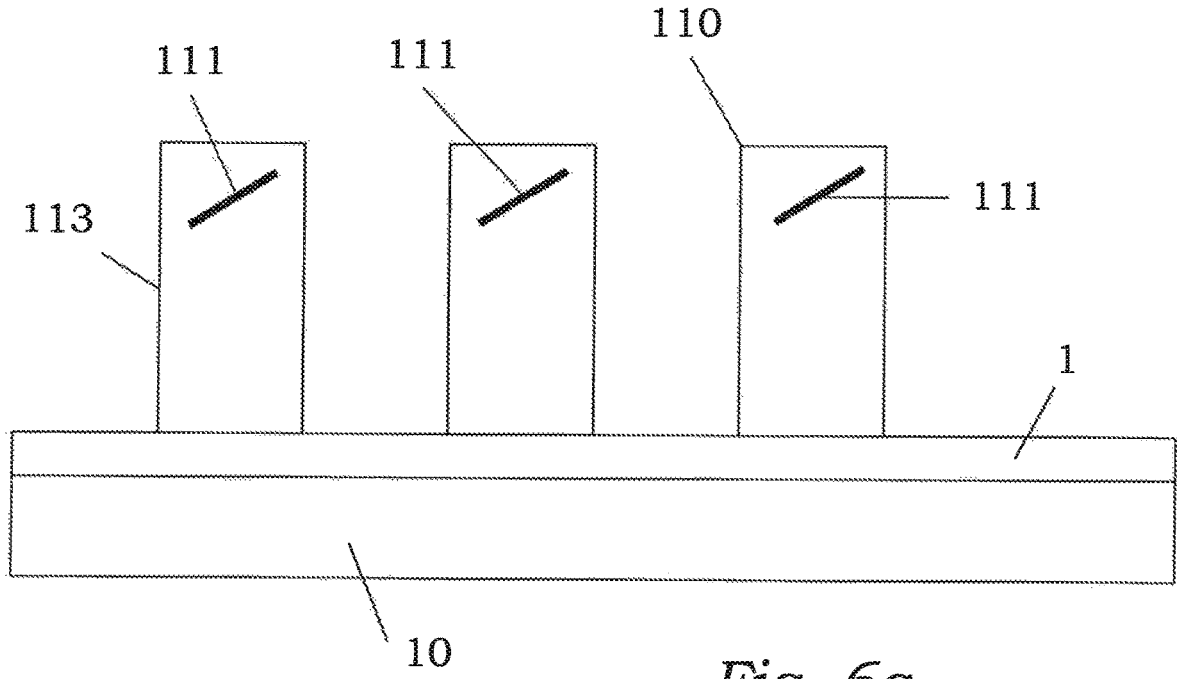
FIG. 6*a* is a schematic diagram of an embodiment of the proposed technology illustrating a cross-section view of a refiner having three refining bars provided with cavities.
Figure 6B:
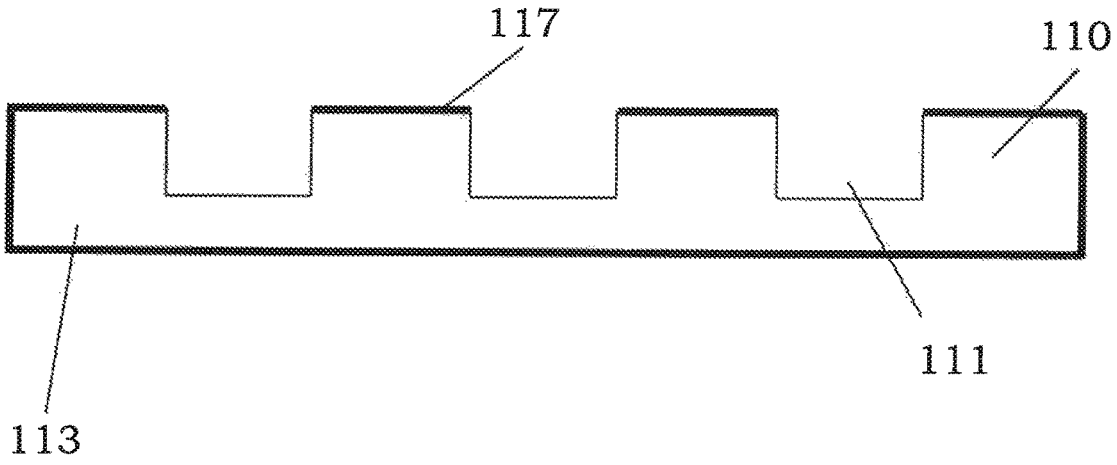
FIG. 6*b* is a schematic end view diagram of a refining bar comprising three cavities in shape of recesses provided on the surface of the refining bar.

FIG. 6*a* provides a schematic illustration of a cross-section of a refiner plate 1 having refining bars 110 provide on the refining surface 11. The refining bars 110 are provided with cavities of a type described earlier. Only three refining bars are illustrated in order to keep the drawing simple. Even though it is not specifically illustrated in FIG. 6*a* the cavities may extend all the way to the upper surface of the refining bar thereby defining recesses on the surface of the refining bar where these recesses get an increasingly larger depth towards the trailing edge 113. A cross-section view taken along a line parallel with the leading edge 112 of a refining bar 110 can be seen in FIG. 6*b*. The refining bar comprises three cavities 111 in the shape of recesses in this particular example. Before the refining bar 110 has been used, the front side of the recesses 111 will be covered by the refining bar material. When the refining bar is used the front side material will get increasingly worn down and new leading edges will emerge as defined by the edges of the recess 111.

Still another embodiment of the proposed technology provides a refiner plate 1 wherein at least one refining bar 110 is provide with at least one cavity 111 that have one end 111*a* arranged closer to the leading edge 112 of a refining bar 110 and one end 111*b* arranged closer to the trailing edge 113 of the refining bar 110 and wherein the depth dimension of the cavity 111 at the end 111*a* is smaller than the depth dimension of the cavity 111 at the end 111*b*.

Figure 11:
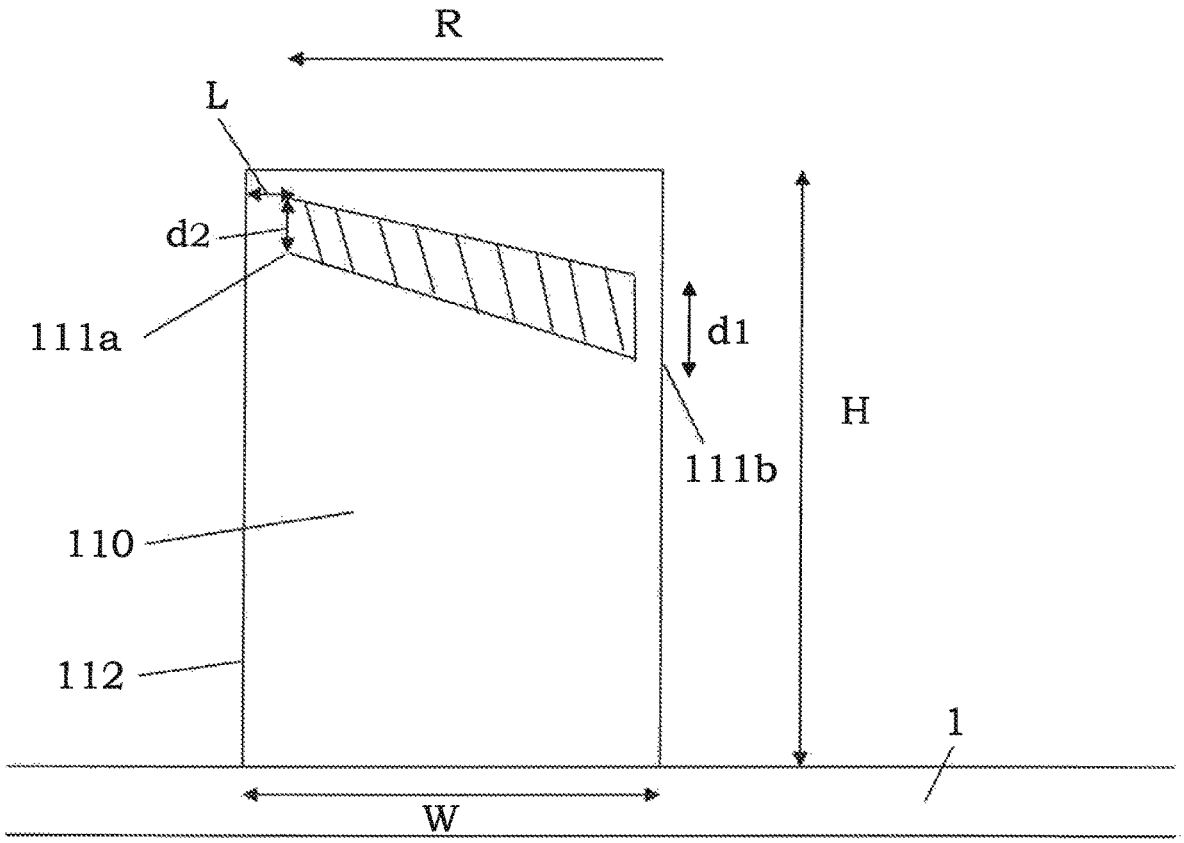
FIG. 11 is a schematic diagram of an embodiment of the proposed technology illustrating a cross-section view of a refining bar comprising a cavity provided in the bulk of the refining bar.

FIG. 11 provides a schematic illustration of this embodiment where it is clear that the end 111*a*, which is arranged closer to the leading edge 112 of the refining bar has a smaller depth dimension than the opposite end 111*b* arranged closer to the trailing edge 113 of the refining bar. This is also illustrated in FIG. 12 where a recess provided on the surface 117 of a refining bar 110 has a larger depth at the trailing edge compared to the leading edge.

The purpose of having gradually increasing depth dimensions is to ensure that the impact on the material flow is reduced as long as possible. Initially the refining bars are in a state where they have experienced minimal wear. The refining plate with a refining bar configuration in this state may be assumed to provide a satisfactory material flow. Any additional structures provided on the refining bars may thus negatively impact the initially satisfying material flow. The proposed technology aims to provide refining bars where hidden edges emerges when the refining bars has experienced wear. Hence during a first state of wear the refining bar may still have some leading edges left, in this state the hidden edges should merely add to the already existing edges but with the constraint that they should have as little impact on the flow as little as possible. Hence a smaller opening is sufficient. The smaller opening provides some additional edges but only barely affects the material flow. This will however change over time, the longer the refining plate is used the more wear the refining bars exhibit and the more of their initial edges they lose. The purpose of the hidden edges in this more worn down state is to add substantially more pronounced leading edges since any impact on the material flow will be compensated by the loss of the initial leading edges on the refining bar, i.e., the leading edges in the non-worn state. The change in depth of the cavities/recesses may thus be seen as a middle way in the trade-off between adding pronounced edges to the refining bar and not affecting the material flow on the refining plate.

Figure 10:
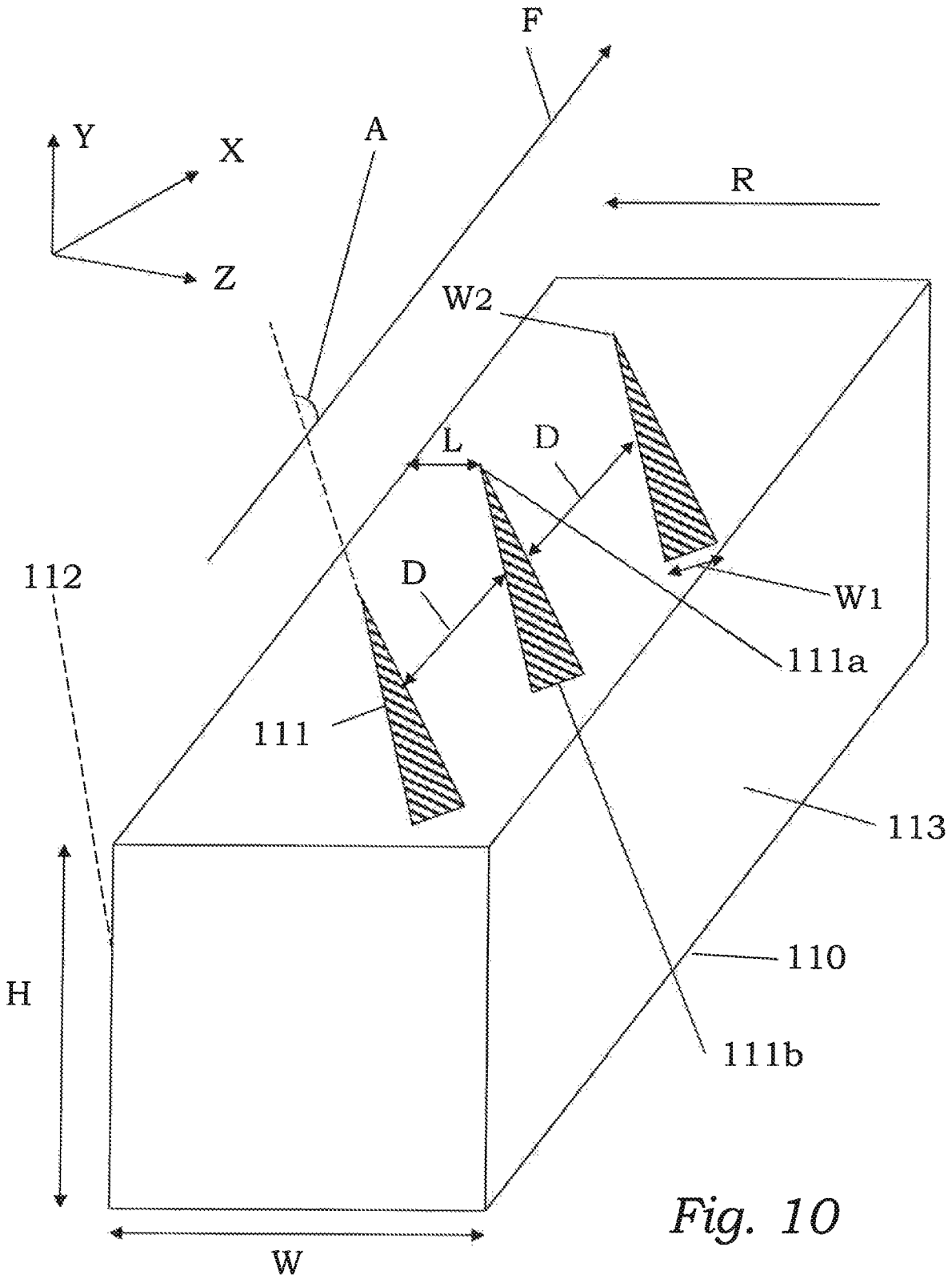
FIG. 10 is a schematic diagram of an embodiment of the proposed technology illustrating a refining bar comprising three wedge shaped cavities provided in the bulk of the refining bar. The direction of the cavities form an angle A with the length direction of the refining bar

Another embodiment of the proposed technology provides a refiner plate 1 wherein at least one refining bar 110 is provided with at least one cavity 111 having one end 111*a* arranged closer to the leading edge 112 of a refining bar 110 and one end 111*b* arranged closer to the trailing edge 113 of the refining bar 110, and wherein the width dimension of the cavity at the end 111*a* closer to the leading edge 112 of the refining bar 110 is smaller than the width dimension of the cavity at the end 111*b* closer to the trailing edge 113 the refining bar 110. FIG. 10 provides a schematic illustration of this embodiment.

The purpose of having a changing width dimension is the same as the corresponding difference in depth dimension, i.e., to provide a middle way between adding pronounce new emerging edges and affecting the material flow.

A combination of the embodiments illustrated in FIGS. 10 and 11 provides a refiner plate 1 that is adapted to be attached to a rotatable refiner disc 10 on a refiner 100 for mechanical treatment of lignocellulosic material. The refiner plate 1 comprises a refining surface 11 that is adapted to be arranged oppositely a second refining surface 21 of a second refiner disc 20 on the refiner 100. The refining surface 11 is provided with a plurality of refining bars 110, and at least a subset of this plurality of refining bars 110 are provided with cavities 111 that are at least partially embedded in the refining bars 110 where the cavities has an elongated shape in the form a wedge. The wedge may be truncated, i.e. the wedge may have one end having a depth $D_1$ and width W1 that is larger than zero and an opposite end having a depth $D_2$ and width $W_2$ that is larger than $D_1$ and W1. This wedge shaped cavity may be angled relative the length direction of the bar and tilted/angled relative the normal direction of the surface, i.e. in a direction orthogonal to the refining surface 11 of the refining plate 1. In this way there will be provided a refining bar 110 having at least one wedge shaped cavity 111 that extends into the bulk of the refining bar 110. The edges of the wedge shaped cavity will be exposed after the refining bar 110 has been worn down. The exposed and emerging edges of the wedge may thus act as secondary leading edges that prolong the effective life span of the refining plate 1. The wedge shaped cavity 111 may either be completely housed within the refining bar bulk material or have an open end on the top surface 117 of the refining bar 110. In the latter case there will be defined a wedge shaped recess 111 on the surface of the refining bar where one end, the end closer to the trailing edge 113 of the refining bar, has a larger depth than the depth at the end closer to the leading edge 112 of the refining bar 100.

FIGS. 7*a*-7*d* provides an illustration of a refining plate 1 having refining bars 110 with an intermediate distance 118. FIG. 7*a* illustrates a cross-section of a common refining plate 1 with regular refining bars 111. FIG. 7*b* illustrates a cross-section of a refining plate 1 with refining bars 111 provided with cavities 111 according to the proposed technology. The cavities are in this particular example provided in the shape of an extended cavity, e.g., in the shape of a channel that runs in the bulk of a refining bar and where one end 111*a* is provided closer to the leading edge 112 of the refining bar. FIG. 7*c* illustrates the regular refining plate of FIG. 7*a* after use when the refining bars 111 has been worn down. Any edges on the refining bars have been smoothened out by the wear and has thus lost a lot of its efficiency. FIG. 7*d* illustrates the refining plate of FIG. 7*b* after use. The additional cavities 111 has been exposed by the wear and secondary edges denoted 109 have emerged. These secondary edges 109 that emerges when the cavities get exposed will be ensure that the refining bars 110 keep their efficiency for a longer time. This will in turn ensure an energy saving grinding action since it delays the need to replace the refining plate since the emerging edges will ensure that an efficient grinding action occurs even though the refining bars have been worn down.

Figure 8:
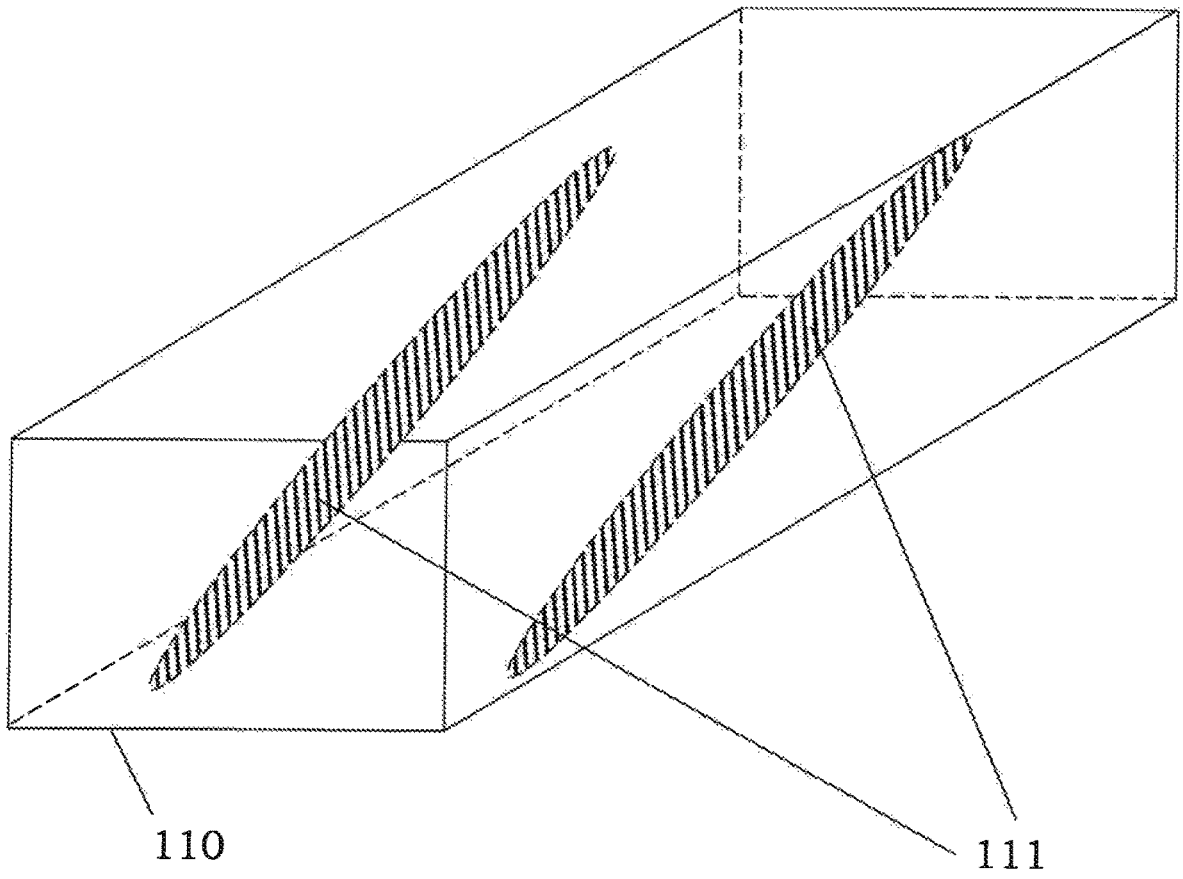
FIG. 8 is a schematic diagram of an embodiment of the proposed technology illustrating a refining bar comprising two cavities provided in the bulk of the refining bar.

FIG. 8 provides an illustration of a single refining bar 110 to be provided on a refining plate 1. The refining bar comprises two added cavities 111 of channel shape that extends into the bulk of the refining bar 110. The cavities are schematically illustrated by the dashed elliptic shapes.

Figure 9:
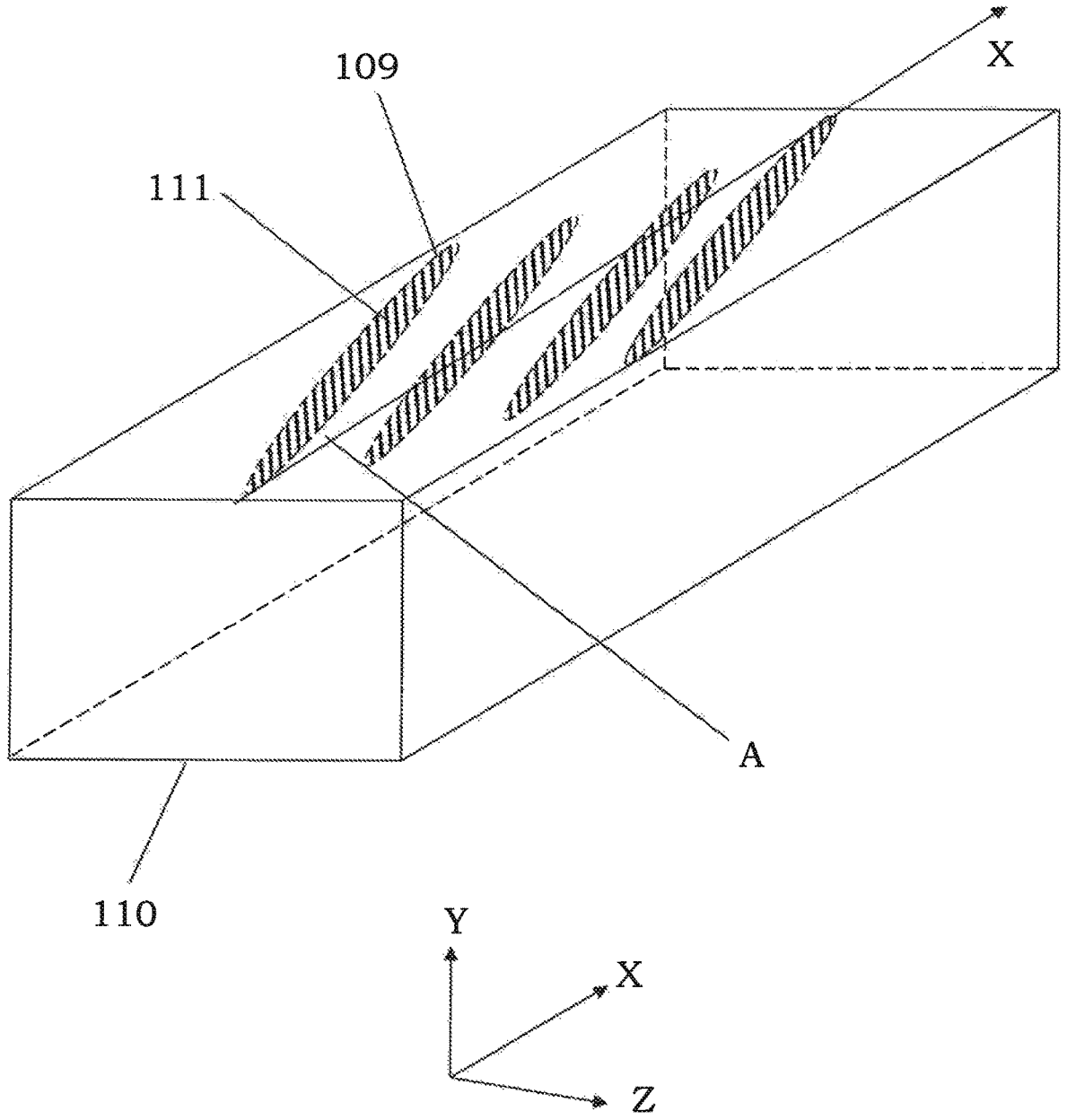
FIG. 9 is a schematic diagram of an embodiment of the proposed technology illustrating a refining bar comprising four cavities provided in the bulk of the refining bar. The direction of the cavities form an angle A with the length direction of the refining bar.

FIG. 9 provides an illustration of a single refining bar 110 to be provided on a refining plate 1. The refining bar comprises four added cavities 111 of an elongated shape that runs on the surface of the refining bar 110. The cavities are schematically illustrated by the dashed elliptic shapes. The cavities are provided on the refining bars in an angled fashion whereby the length direction of the cavities form an angle A with the length direction of the bars.

FIG. 10 provides a schematic diagram of single refining bar 110 provided with three cavities 111 having an elongated shape. The cavities 111 includes ends 111*a* and 111*b*. The end 111*a* will be arranged in the refining bar 110 so that it is closer to the leading edge 112 of the refining bar while the end 111*b* will be arranged closer to the trailing edge 113 of the refining bar.

FIG. 10 also illustrates another particular feature of the proposed technology. This particular feature relates to a refiner plate 1 wherein at least one refining bar 110 is provided with cavities 111 that have an intermediate spacing D, where the intermediate spacing D is larger or equal to the width W of the refining bar. This embodiment provides a refining plate that reduces the risk of refining bar breaks. It thus provides high-strength refining bars.

FIG. 10 illustrates further the length direction of the bar, denoted F and running in the X-direction of this particular coordinate system, relative the direction of rotation, denoted R, of the refining plate 1. In this particular embodiment, the cavities are provided on the refining bar 110 so that an angle A is defined between the direction of the refining bar and the direction of the cavities. The cavities are furthermore provided on the refining bar with an intermediate spacing D. The spacing D between adjacent cavities should preferable be larger than, or equal to, the width W of the refining bars.

Yet another embodiment of the proposed technology will ensure that the emerging edges will get more and more pronounced the more worn down the refining bars become. This particular embodiment provides a refiner plate 1 wherein the cavities 111 have an elongated shape and are provided on a refining bar 110 so that they have one end 111*a* arranged closer to the leading edge 112 of a refining bar 110 and one end 111*b* that is arranged closer to the trailing edge 113 of the refining bar and wherein the width $d_1$ of the cavity 111 at the end 111*a* closer to the leading edge 112 is larger than the width $d_2$ of the cavity at the end 111*b* closer to the trailing edge. This embodiment is schematically illustrated in FIG. 11. The direction of rotation of the refining plate is denoted by R. The purpose of this design is to ensure that more and more of a cavity 111 is exposed the more worn down a bar becomes. As a consequence new and well pronounced edges will emerge when the bar becomes substantially worn down. This will in turn ensure that the grinding remains effective while at the same time reducing any major influence on the material flow on the refining plate. The embodiment in FIG. 11 illustrates how a cavity 111 that is embedded in the refining bar gets a gradually increasing depth. A corresponding embodiment where the cavity comprises a recess provided on the top surface 117 is shown in FIG. 12. In this cross-section view along the length direction of a recess 111 it can be seen how the depth of the recess 111 gets gradually larger the farther one is from the leading edge 112 of the refining bar.

By way of example, the proposed technology also provides a refiner plate wherein at least one of the refining bars 110 are provided with at least one cavity 111 having one end 111*a* arranged closer to the leading edge 112 of the refining bar 110 and one end 111*b* arranged closer to the trailing edge 113 of the refiner bar 110 and wherein the end 111*a* arranged closer to the leading edge 112 of the refining bar begins at a distance L from the leading edge of the refining bar 110, the distance L lying in the interval: $0<L<\frac{1}{2}W$, where W denotes the width of the refining bar 110. FIG. 10 or 11 provides a schematic illustration of this embodiment where it can be seen that the end 111*a* of a cavity 111 begins at a distance L from the leading edge 112 of the refining bar 110. This embodiment ensures that the cavities 111 does not disturb the material flow on the refining plate before the refining bars 110 has been worn down and the secondary edges defined by the cavities gets exposed.

With the help of FIGS. 10 and 11 we will now provide some preferable dimensions for the parameters that define the cavities. These values has proven to be suitable in order to achieve the goals of the proposed technology, e.g., extending the life length of a refining plate, lower the energy cost over time, improving the fiber quality and also improving the flow distribution of e.g., wood and steam.

First of all, the depth $d_2$ of a cavity, that is, the depth of the cavity 111 at the end 111*a* closest to the leading edge 112 of a refining bar 110, should preferable be smaller than the depth $d_1$ of the cavity at the end 111*b* closest to the trailing edge 113 of the refining bar. The depth $d_1$ of the cavity at the end closest to the trailing edge 113 should in turn preferable be smaller than ½ H, where H denotes the height of the refining bar 110.

The width $W_2$ of the cavity 111 at the end 111*a* closest to the center of the refining plate 1, should preferable be smaller than the width W of the refining bar. The width $W_1$ of the cavity at the end 111*b* closest to the periphery of the refining plate 1 should preferable be smaller than the width W of the refining bar 110. The width $W_2$ of the cavity 111 at the end 111*a* closest to the center of the refining plate 1 may in certain embodiments be smaller than the width $W_1$ of the cavity at the end 111*b* closest to the periphery of the refining plate 1.

The distance D between adjacent cavities 111 should preferably be larger than the width of the refining bar 110.

The ledge L, which denotes the distance between the cavity end 111*a* closest to the leading edge 112 of a refining bar 110, and the leading edge 112 should preferably be smaller than ½W, where W denotes the width of the refining bar 110.

The angle A between the length direction of the refining bar 110 and the length direction of a cavity 111 should preferably lie in the interval $5°<A<45°$. And the angle B between the length direction of the cavities 111 and the direction of the normal to the refining surface 11 should preferably lie in the interval $5°<B<45°$.

It is preferable that the dimension of the cavities 111 provided in the refining bars are not too large to ensure that the refining bars does not break during use. A particular embodiment of the proposed technology relates to cavities 111 that are provided in the shape of elongated channels that extend into the bulk of the refining bars. It is preferable if the length dimension of these channels lie in the interval {¼H, ½H}, even more preferable in the interval {⅓H, ½H}, where H denotes the height of the refining bar. Hence if for example the height of the refining bar is approximately 1 cm, the length dimension may lie in the interval {0.25 cm, 0.5 cm}, preferably in the interval {0.33 cm, 0.5 cm}.

The invention claimed is:

1. A refiner plate arranged to be attached to a rotatable first refiner disc on a refiner for mechanical treatment of lignocellulosic material, the refiner plate comprising:

a first refining surface; and a plurality of refining bars on the first refining surface, the first refining surface configured to be disposed opposite a second refining surface of a second refiner disc disposed on the refiner, wherein at least one of the refining bars has cavities, at least one of which is completely embedded in the at least one refining bar, at least one of the cavities has:

a first end arranged closer to a leading edge of the at least one refining bar, and a second end arranged closer to a trailing edge of the at least one refining bar, and wherein a depth dimension of the at least one of the cavities at the first end is smaller than a depth dimension of the at least one of the cavities at the second end.

2. The refiner plate according to claim 1, wherein the cavities have an elongated shape.

3. The refiner plate according to claim 1, wherein the cavities are disposed in the at least one refining bar in such a way that an angle A, $0° < A < 45°$, is formed between a length direction of the at least one cavity and a length direction of the at least one refining bar.

4. The refiner plate according to claim 3, wherein the cavities have an elongated shape.

5. The refiner plate according to claim 1, wherein the cavities are provided in the at least one refining bar so that a length direction of the cavities form an inclination angle B, $0° < B < 45°$, with a direction of a normal of the first refining surface.

6. The refiner plate according to claim 1, wherein a width dimension of the at least one cavity at the first end closer to the leading edge of the at least one refining bar is smaller than a width dimension of the at least one cavity at the second end closer to the trailing edge of the refining bar.

7. The refiner plate according to claim 6, wherein at least one of the cavities comprises a recess on an upper surface of the at least one refining bar, thereby forming at least one cavity that is partially embedded in the at least one refining bar.

8. The refiner plate according to claim 1, wherein at least one of the refining bars are provided with cavities having an intermediate spacing D, the intermediate spacing D being larger or equal to a width W of the at least one refining bar.

9. The refiner plate according to claim 1, wherein the first end arranged closer to the leading edge of the at least one refining bar begins at a distance L from the leading edge of the at least one refining bar, the distance L lying in the interval: $0 < L \leq ½ W$, where W denotes a width of the at least one refining bar.

10. A refiner for mechanical treatment of organic/cellulosic material, the refiner comprising two oppositely arranged refiner discs, wherein at least one of the refiner discs comprises a rotatable refiner disc and at least one of the refiner discs comprises a refiner plate according to claim 1.

* * * * *